US011308904B2

(12) United States Patent
Xiong

(10) Patent No.: US 11,308,904 B2
(45) Date of Patent: Apr. 19, 2022

(54) DISPLAY PANEL

(71) Applicant: HKC CORPORATION LIMITED, Shenzhen (CN)

(72) Inventor: Zhi Xiong, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/043,673

(22) PCT Filed: Nov. 9, 2018

(86) PCT No.: PCT/CN2018/114759
§ 371 (c)(1),
(2) Date: Sep. 30, 2020

(87) PCT Pub. No.: WO2020/082437
PCT Pub. Date: Apr. 30, 2020

(65) Prior Publication Data

US 2021/0020131 A1 Jan. 21, 2021

(30) Foreign Application Priority Data

Oct. 22, 2018 (CN) ..... 201811231856.4

(51) Int. Cl.
*G09G 3/36* (2006.01)

(52) U.S. Cl.
CPC ..... *G09G 3/3614* (2013.01); *G09G 3/3688* (2013.01); *G09G 2320/0233* (2013.01)

(58) Field of Classification Search
CPC .. G09G 3/3614; G09G 3/3648; G09G 3/3688; G09G 3/3677; G09G 3/3685; G09G 2320/0233; G09G 2320/0247; G09G 2300/0426; G09G 2310/0297; G09G 2310/08
See application file for complete search history.

(56) References Cited

U.S. PATENT DOCUMENTS

2002/0024482 A1* 2/2002 Song ..... G09G 3/3614 345/87
2004/0239602 A1* 12/2004 Kim ..... G09G 3/3648 345/87
2006/0055648 A1* 3/2006 Kamada ..... G02F 1/13452 345/87
2016/0049125 A1* 2/2016 Yao ..... G09G 3/3614 345/209

(Continued)

FOREIGN PATENT DOCUMENTS

CN 102236231 A 11/2011
CN 102629456 A 8/2012

(Continued)

OTHER PUBLICATIONS

International Search Report of PCT/CN2018/114759.

*Primary Examiner* — Dong Hui Liang
(74) *Attorney, Agent, or Firm* — Kilpatrick Townsend & Stockton, LLP

(57) ABSTRACT

The data driver of the display panel of the present disclosure is configured to control an output mode of a data signal, and the output mode includes a first drive mode and a second drive mode. In different frames, data signals are outputted according to the first drive mode and second drive mode, respectively.

19 Claims, 7 Drawing Sheets

(56) References Cited

U.S. PATENT DOCUMENTS

| | | | | |
|---|---|---|---|---|
| 2016/0363830 | A1* | 12/2016 | Chen | G02F 1/136213 |
| 2016/0365045 | A1* | 12/2016 | Chen | G09G 3/3677 |
| 2016/0365046 | A1* | 12/2016 | Chen | G09G 3/3614 |

FOREIGN PATENT DOCUMENTS

| | | | |
|---|---|---|---|
| CN | 103208265 | A | 7/2013 |
| CN | 104062820 | A | 9/2014 |
| CN | 104751808 | A | 7/2015 |
| CN | 104882110 | A | 9/2015 |
| CN | 105116656 | A | 12/2015 |
| TW | 200816126 | A | 4/2008 |

* cited by examiner

DISPLAY PANEL

CROSS REFERENCE TO RELATED APPLICATIONS

This application is a U.S. National Stage Entry of International Application No. PCT/CN2018/114759, filed on Nov. 9, 2018, which claims priority to Chinese Patent Application No. 201811231856.4, filed on Oct. 22, 2018, entitled as "DISPLAY PANEL", the entire contents of which are incorporated herein in their entireties.

FIELD

The present disclosure relates to the field of display, and particularly relates to a display panel.

BACKGROUND

With the development of display technology, Half Source Driver (HSD) technology is introduced. In the display panel of the HSD, two adjacent sub-pixels share one data line. Therefore, the data line thereof can be reduced by half compared to the exemplary display panel. Meanwhile, in the display panel of the HSD, sub-pixels spaced apart from each other in the same row are connected to the same scan line, and adjacent sub-pixels in the same row are connected to different scan lines. Thus, the number of scan lines thereof is in turn doubled with respect to the exemplary display panel.

In a liquid crystal display panel, a sub-pixel includes a thin film transistor. A scan line is connected to a gate of the thin film transistor for providing a scan signal to turn on the sub-pixel; the data line is connected to a source stage of the thin film transistor for providing a data signal and charging the sub-pixel. Due to the delay effect of the RC signal, the waveform of the data signal is not an ideal square wave and has a starting end and a trailing end. The data signal gradually rises toward a predetermined value at the beginning of the waveform and reaches the predetermined value at the end of the waveform. Therefore, in the same frame picture, in the same period, the charge amount of the sub-pixel charged through the starting end of the data signal is relatively small; And the amount of charge of the sub-pixels charged through the trail end of the data signal is relatively large.

In the display panel of HSD, when the screen refresh frequency per second is constant, the scan line is doubled, the opening time of each sub-pixel is shortened, and the sub-pixel charge difference caused by the data signal delay becomes obvious, causing each sub-pixel to display unevenly, In one embodiment, creating vertical bright and dark lines.

SUMMARY

Accordingly, it is necessary to provide a display panel that can improve the display uniformity of each of the sub-pixels to address the foregoing problems.

A display panel includes:

scan lines extending in a first direction and configured to provide a scan signal;

data lines extending in a second direction and intersecting the scan line and configured to provide a square wave data signal; and a waveform of the data signal includes sub-waveforms, the sub-waveforms having a starting end and a trailing end; at the starting end, a polarity of the data signal is inverted and the data signal gradually rises toward a predetermined value; and at the trail end, the polarity of the data signal is constant and the data signal reaches the predetermined value;

a sub-pixel group connected to the scan lines and the data lines; the sub-pixel group includes a first sub-pixel and a second sub-pixel;

and a data driver connected to the data lines and configured to control an output mode of the data signal, the output mode including a first drive mode and a second drive mode; in the first drive mode, the first sub-pixel is charged through the data signal at the starting end, and the second sub-pixel is charged through the data signal at the trailing end; in the second drive mode, the first sub-pixel is charged through the data signal of the trail end, and the second sub-pixel is charged through the data signal of the starting end;

the data driver controls the data signal and the data signal is outputted according to the first drive mode in one frame and according to the second drive mode in another frame.

Other characteristics, purposes and advantages of the present disclosure will be apparent from the specification, drawings and appended claims.

DETAILED DESCRIPTION OF THE EMBODIMENTS

It should be understood that the specific embodiments described herein are merely intended to explain rather than limit the present application.

Display panel provided by the present disclosure can be applied to a liquid crystal display device or a liquid crystal display apparatus, such as, a liquid crystal display screen, a liquid crystal television etc.

Figure 1:
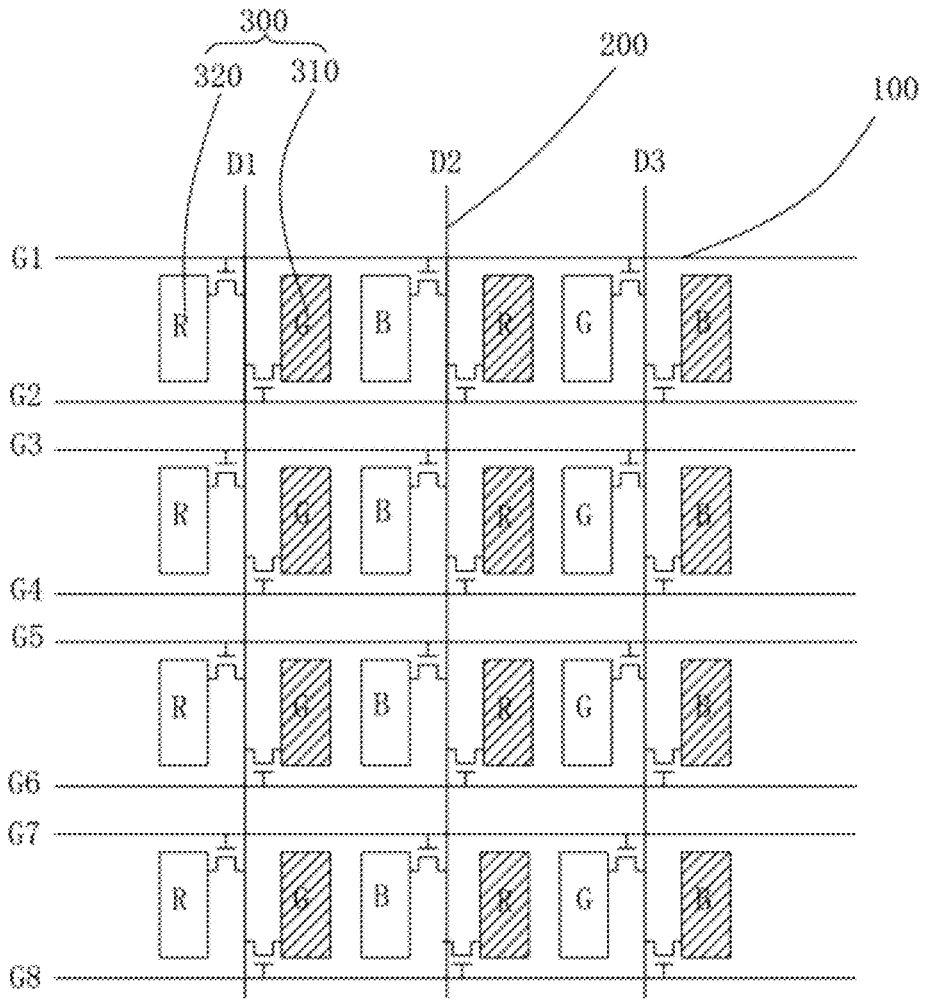
FIG. 1 is a schematic view of a display panel in which data signal is outputted according to a first drive mode according to an embodiment.

As shown in FIG. 1, in an embodiment, a display panel is provided, which includes scan lines 100, data lines 200, a sub-pixel group 300, and a data driver (not shown).

Figure 2:
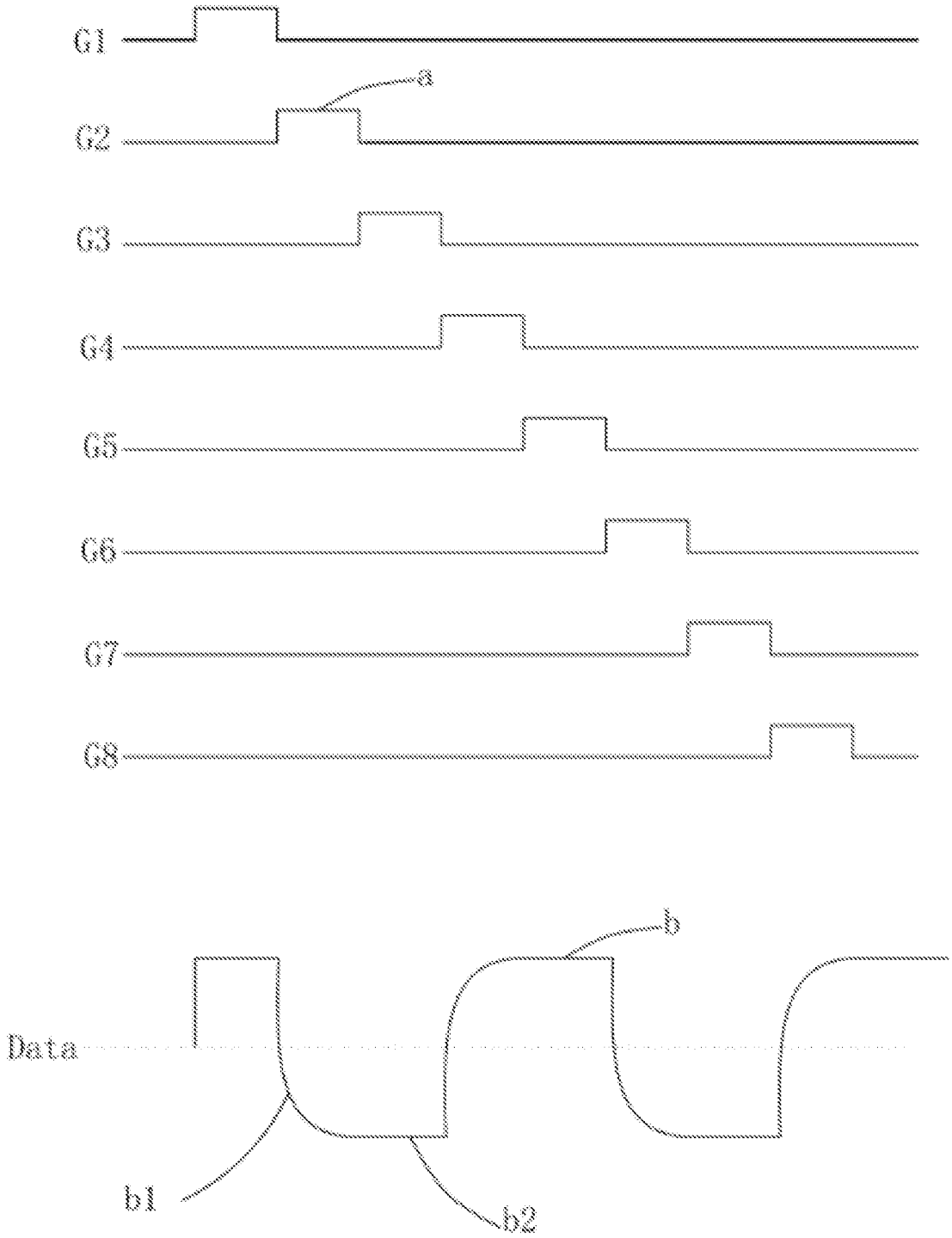
FIG. 2 is a graph of a driving waveform of a scan signal on a scan line and a data signal on a data line according to the embodiment of FIG. 1.

Referring to FIGS. 1 and 2, the scan lines 100 extend in a first direction and is configured to provide a scan signal a. The data lines 200 extend in a second direction and is configured to provide a square wave data signal b. The data signal b includes sub-signals, and when the scan lines 100 provide one scan signal a, the data lines provide one sub-signal. In one embodiment, the first direction may be a horizontal direction, and the second direction may be a vertical direction (referring to FIG. 1). The actual numbers of the scan lines 100 and the data lines 200 are plural (the numbers of the scan lines and the data lines shown in FIG. 1 are illustrative only and does not limit this disclosure), and the scan lines 100 and the data lines 200 are arranged intersecting, and several sub-pixel regions are defined.

The sub-pixel group 300 includes a first sub-pixel 310 and a second sub-pixel 320. The first sub-pixel 310 and the second sub-pixel 320 are located in corresponding sub-pixel regions, and connected to both the scan line 100 and the data line 200. In particular, the first sub-pixel 310 and the second sub-pixel 320 both include a thin film transistor (not shown), a pixel electrode (not shown) connecting the drain of the thin film transistor, a common electrode (not shown) provided opposite to the pixel electrode, and liquid crystal molecules (not shown) between the pixel electrode and the common electrode. The scan line 100 is connected to the gate of the thin film transistor for providing a scan signal to turn on the first sub-pixel 310 and the second sub-pixel 320. The data line 200 is connected to a source stage of a thin film transistor for providing a data signal to charge the first sub-pixel 310 and the second sub-pixel 320. The first sub-pixel 310 and the second sub-pixel 320 may each include a red sub-pixel R, a green sub-pixel G, a red sub-pixel B etc.

The display panel in the embodiments of this disclosure is driven by a half source drive mode. In one embodiment, the first sub-pixel 310 and the second sub-pixel 320 adjacent in the first direction (horizontal direction in FIG. 1) are connected to one data line 200. The first sub-pixel 310 and the second sub-pixel 320 are turned on by the scan signal a of the scan line 100 and charged by the data signal b of the data line 200. In order to make the first sub-pixel 310 and the second sub-pixel 320 to be independently displayed, the first sub-pixel 310 and the second sub-pixel 320 connected to one data line 200 are respectively connected to two different scan lines 100.

Referring to FIG. 2, due to the RC signal delay effect, the waveform of the data signal b supplied from the data line 200 is bent at a voltage inversion position. In one embodiment, the waveforms of the data signal b provided by the data line 200 includes sub-waveforms each has a starting end b1 and a trailing end b2. At the starting end b1, the polarity of the data signal b is inverted and the data signal b gradually rises toward a predetermined value. At the trailing end b2, the polarity of the data signal b is constant and the data signal b reaches the predetermined value. Therefore, referring to FIG. 1, in the same frame picture, the sub-pixel (e.g., the first sub-pixel 310) charged by the data signal of the starting end b1 is relatively dark; the sub-pixel (e.g., the second sub-pixel 320) charged by the data signal of the trailing end b2 is relatively bright.

It should be noted that, the data signals of the starting end b1 and the trailing end b2 herein refer to data signals for a time period corresponding to one scan signal.

The display panel further includes the data driver connected to the data line 200 and configured to control the output of the data signal b. In the embodiments of the present disclosure, under the control of the data driver, the output mode of the data signal b includes a first drive mode and a second drive mode. In the first drive mode, the first sub-pixel 310 charged by the data signal of the starting end b1 is darker, and the second sub-pixel 320 charged by the data signal of the trailing end b2 is brighter. In the second drive mode, the first sub-pixel 310 charged by the data signal of the trailing end b2 is brighter, and the second sub-pixel 320 charged by the data signal of the starting end b1 is darker.

The data driver controls the data signal b, and the data signal b is outputted in the first drive mode in one frame and in the second drive mode in another frame. That is, the data signal b is outputted according to the first drive mode and the second drive mode respectively in different frames. And the brightness effect of the first sub-pixel 310 and the second sub-pixel 320 in the first drive mode is opposite to that in the second drive mode. Therefore, neither the first sub-pixel 310 nor the second sub-pixel 320 will always be relatively bright, or will always be relatively dark, so that the overall visual display effect obtained by integrating the brightness effects of each of the frames is more uniform.

Figure 4:
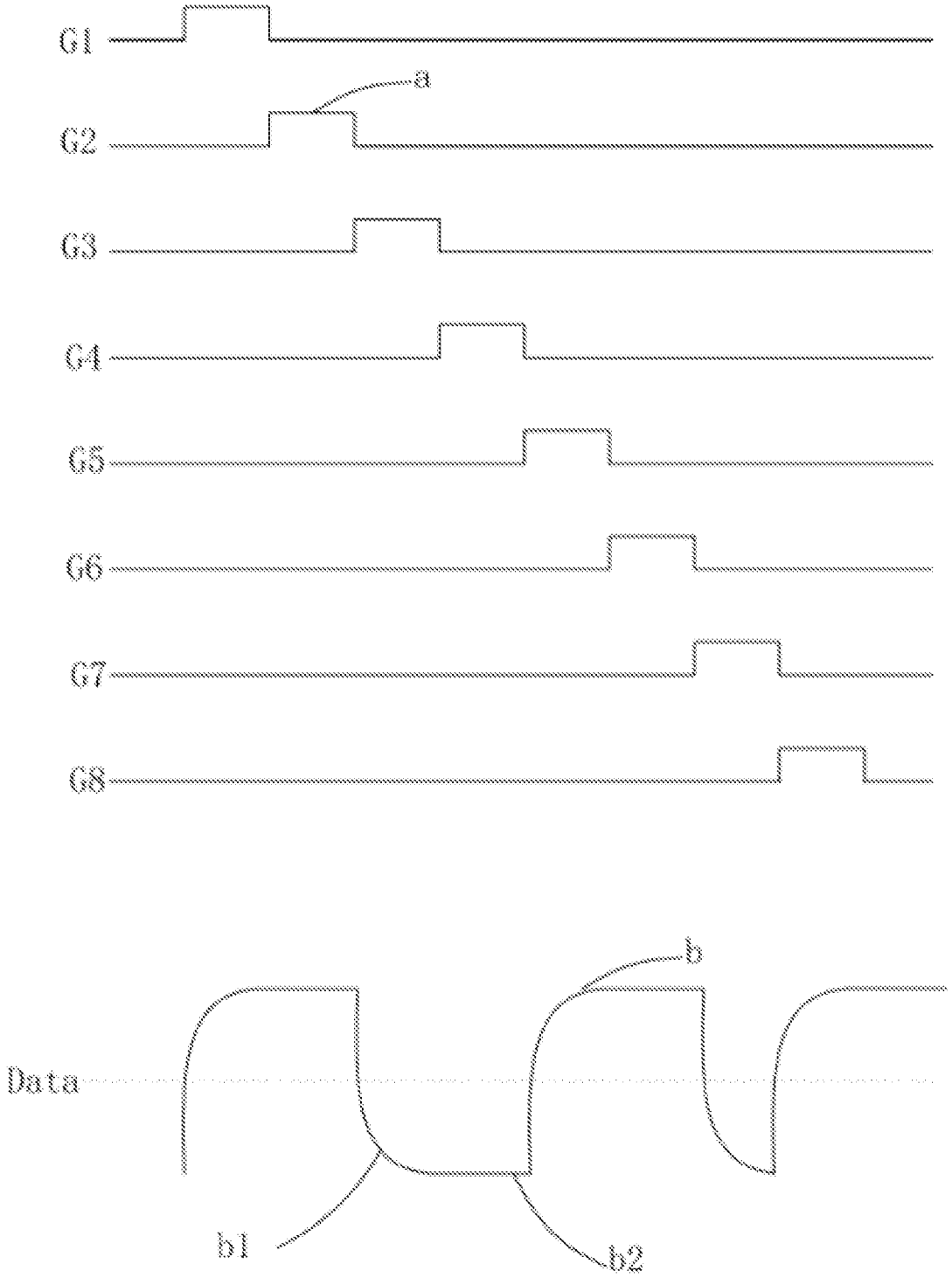
FIG. 4 is a schematic view of a driving waveform of a scan signal on a scan line and a data signal on a data line according to the embodiment shown of FIG. 3.

In the embodiments of the present disclosure, a duration of one scan line providing a scan signal is T (i.e., a duration for a row of scan signals is T). In one embodiment, the first drive mode can be that after the scan signal a is applied, the polarity of the data signal b is inverted for one time after one T, and then inverted every 2T, that is, an invert drive mode of 1+2 line (see FIG. 2). The second drive mode is an invert drive mode, in which, after the scan signal is applied, the polarity of the data signal is inverted every 2T, that is, a 2 line invert drive mode (see FIG. 4). At this time, the first sub-pixel 310 is located in an even column, and the second sub-pixel 320 is located in an odd column.

Figure 3:
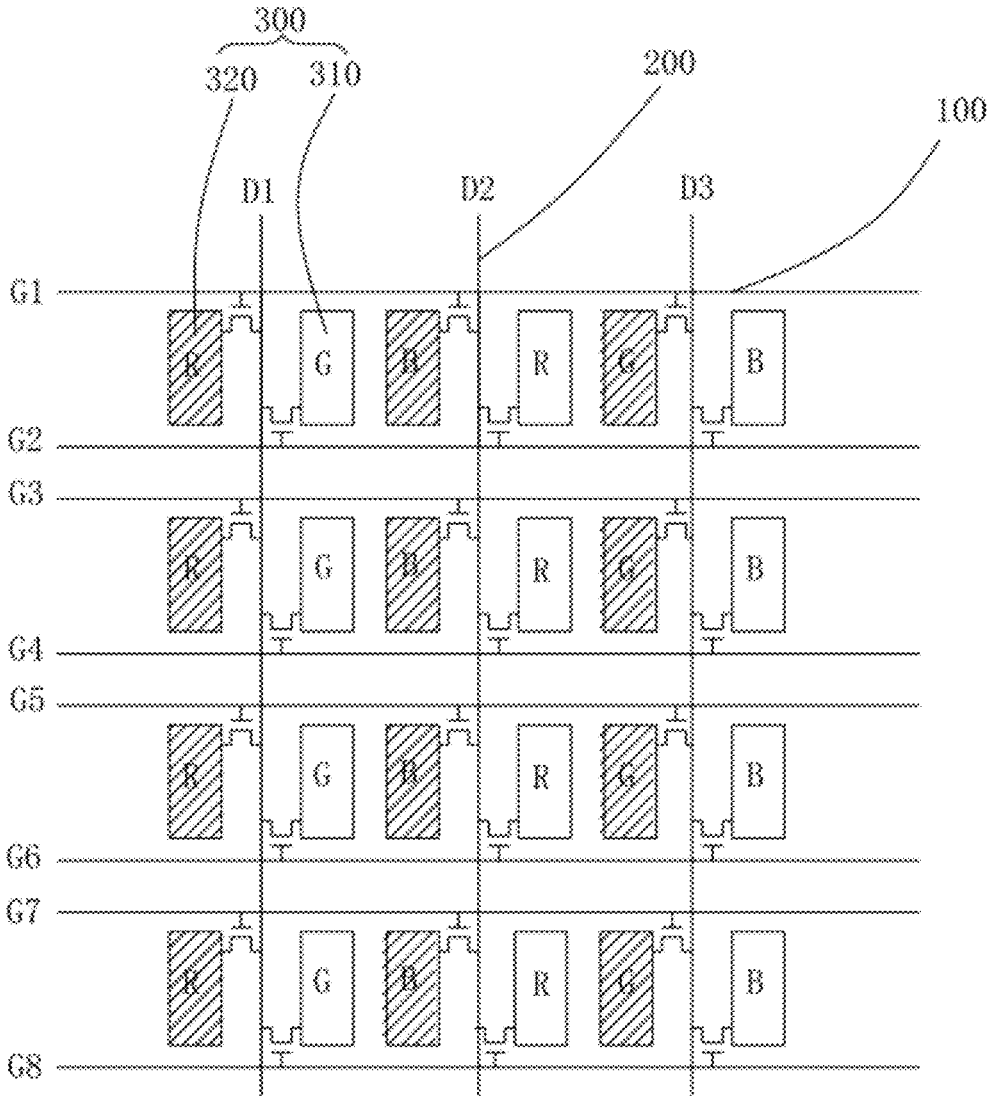
FIG. 3 is a schematic view of a display panel in which a data signal is outputted according to a second drive mode according to an embodiment.

At this time, when the data signal b is outputted according to the first drive mode, referring to FIG. 1, the second sub-pixel 320 of the odd column charged by the data signal of the trailing end b2 is relatively bright, the first sub-pixel 310 of the even column charged by the data signal of the starting end b1 is relatively dark. When the data signal b is outputted according to the second drive mode, referring to FIG. 3, the second sub-pixel 320 of the odd column charged by the data signal of the starting end b1 is relatively dark, the first sub-pixels 310 of the even columns charged by the data signals of the trail end b2 are relatively bright.

Of course, in the embodiments of the disclosure, the first drive mode can be configured as a 2 lines invert drive mode and the second drive mode can be configured as a 1+2 lines invert drive mode. In one embodiment, the first drive mode and the second drive mode may be both different, as long as the same first sub-pixel 310 and the same second sub-pixel 320 may exhibit opposite brightness effects in different frames.

The final display effect of the display panel is a superposition of the display effect of multiple frames. If the display effect is relatively uniform during the superposition process, it is advantageous to make the final display effect more uniform.

In the embodiments of the disclosure, the output mode of the data driver control data signal b may be configured and frames are taken as one cycle, so that the display process is periodic, and the display process uniformity is enhanced. In one embodiment, an even number of frames may be one cycle, or an odd number of frames may be one cycle.

In an embodiment, the output mode of the data driver control data signal b takes an even number (e.g., two, four, six, eight, etc.) of frames as one cycle. In one cycle, the number of frames in which the data signal b being outputted according to the first drive mode is the same as the number of frames in which the data signal b being outputted according to the second drive mode. Therefore, in one cycle, the number of frames in which the first sub-pixel 310 and the second sub-pixel 320 are relatively bright is the same as the number of frames in which the first sub-pixel 310 and the second sub-pixel 320 are relatively dark in one cycle. Therefore, in one cycle, the superposition display effect of each of the sub-pixels is relatively uniform, and the final display effect after several cycles of superposition is more uniform.

In one embodiment, it may be configured that, in one cycle, the data signal b is outputted according to the first drive mode in the first half cycle, and the data signal b is outputted according to the second drive mode in the second half cycle. At this time, the control of the data signal b by the data driver is better facilitated.

Of course, other configurations may also be employed. In one embodiment, taking six frames as one cycle, a first frame, a second frame, and a fourth frame of the data signal b within one cycle are outputted in a first drive mode; the third frame, the fifth frame, and the sixth frame are outputted in the second drive mode.

The above embodiment takes an even number of frames as one cycle, that is, 2n frames as one cycle, and n is a positive integer greater than or equal to 1. The smaller the value of n, the higher the uniformity of brightness during the superposition of the display effect. When n is configured to be 1, i.e., two frames are taken for one cycle. At this time, the sub-pixel (e.g., the second sub-pixel 320) relatively bright in the previous frame may be made relatively dark in the next frame; whereas the sub-pixel (e.g., first sub-pixel 310) relatively dark in the previous frame is relatively bright in the next frame. In the process of superposition of the display effect, each of the sub-pixels can always be in a light-dark transitioning state, which is favorable to the uniformity of the final display effect. To the extent allowed by the display need, it can be configured that $1 \leq n \leq 4$, preventing the brightness uniformity in the superimposition process from being lowered when the n value is increased.

Meanwhile, the above embodiment effectively improves the deficiency of display unevenness (In one embodiment, there are vertical bright-dark lines) by configuring different output modes of data signals so that the brightness effects of different frames are different. However, if the same sub-pixel (the first sub-pixel 310 and the second sub-pixel 320) is always charged with a data signal of a polarity (positive polarity or negative polarity) in different frame, the driving voltage of the liquid crystal molecules therein is fixed to a polarity for a long time. Then a polarization phenomenon would happen in the liquid crystal molecules, and the optical rotation characteristic is gradually lost.

Figure 5:
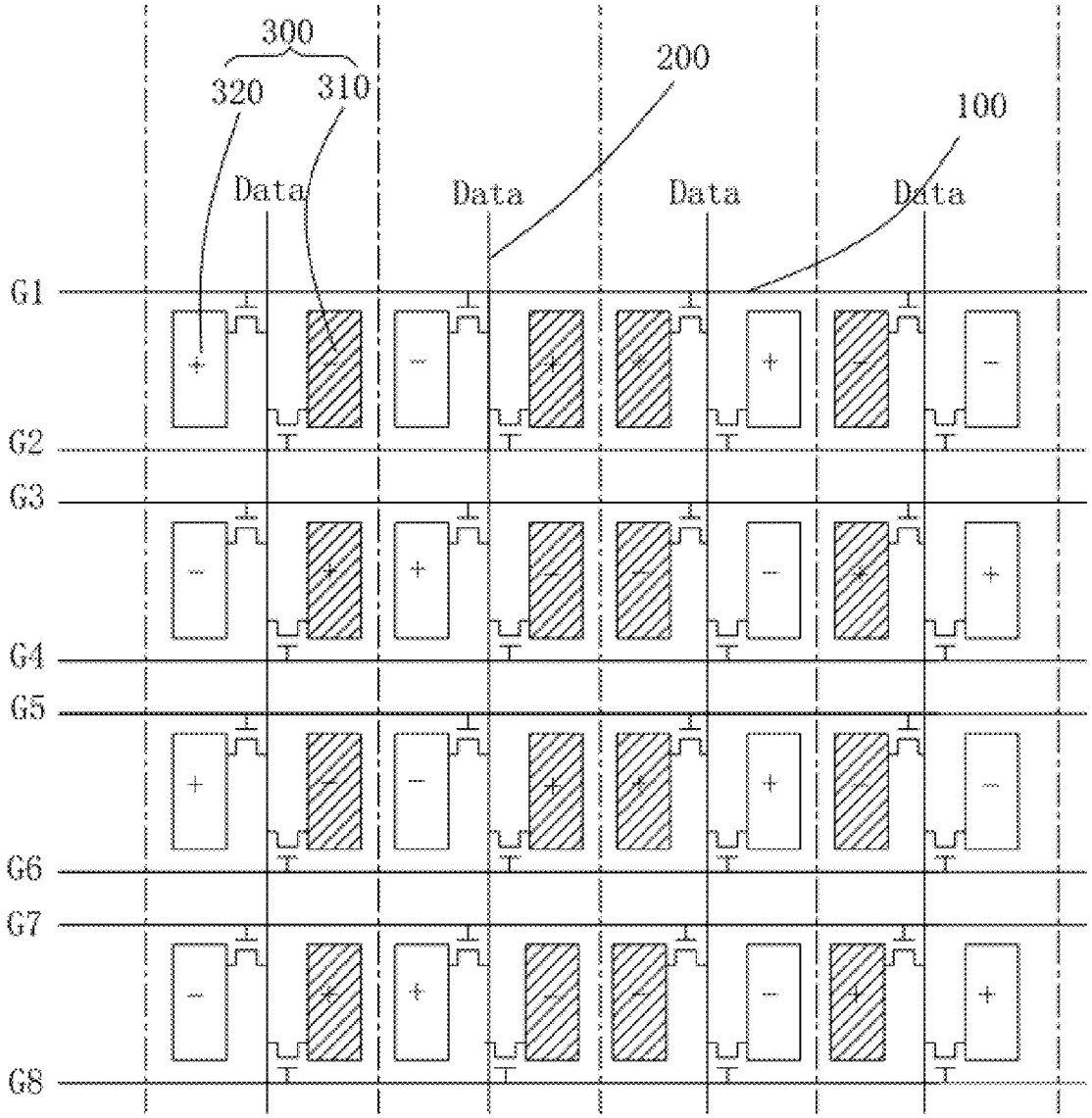
FIGS. 5-7 are display timing charts of a display panel with four frames as one cycle according to different embodiments.
Figure 6:
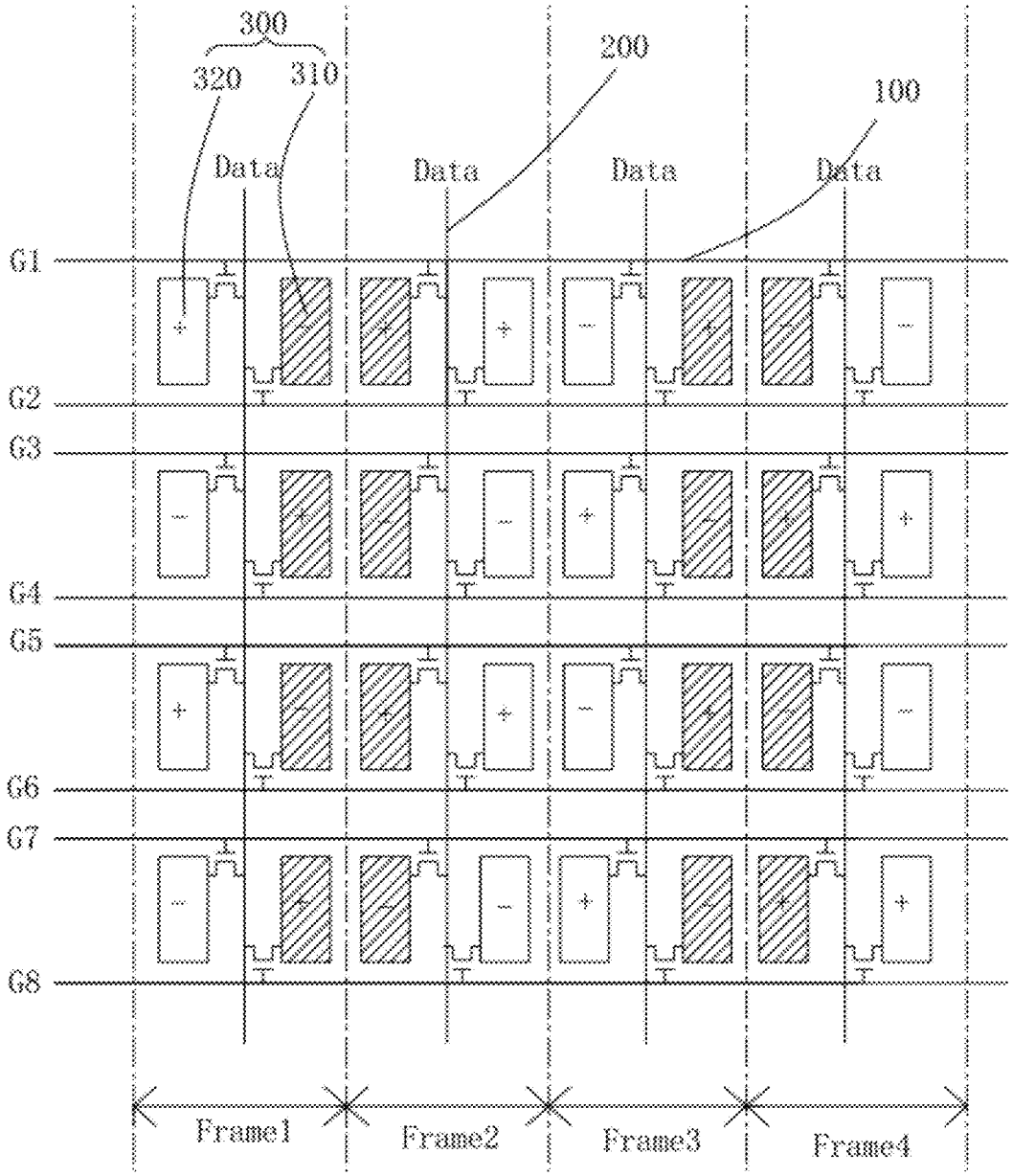
Figure 7:
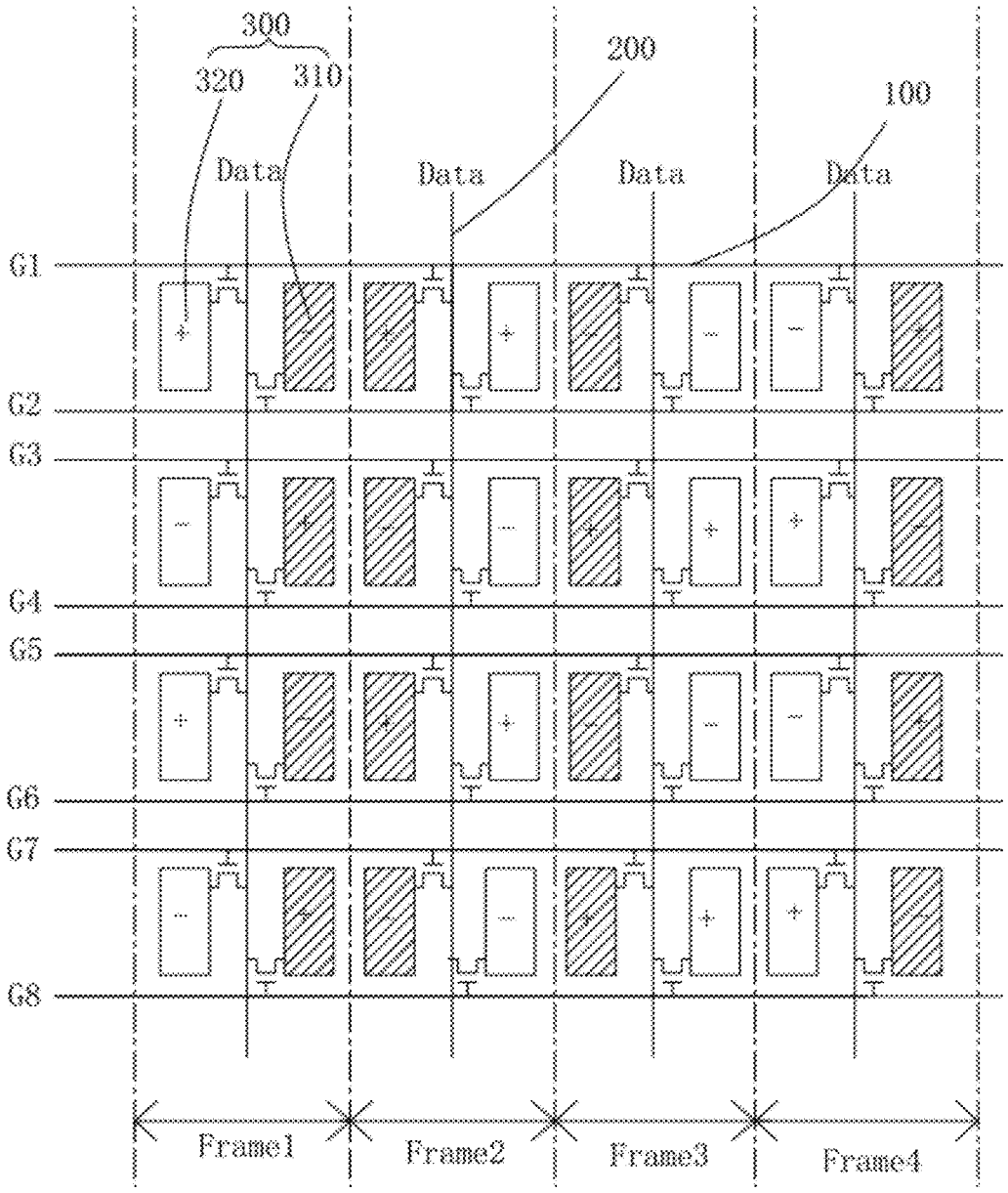

Therefore, in an embodiment, referring to FIGS. 5 to 7, in one cycle, the number of frames in which the data signal b being outputted according to the first drive mode is configured to be the same as the number of frames in which the data signal b being outputted according to the second drive mode. Also, in each of the frames of one cycle, it is configured that the sub-signals (as described, the data signal includes sub-signals) charging the same first sub-pixel 310 includes a sub-signal in a positive polarity and a sub-signal in a negative polarity; also, it is configured that the sub-signal charging the same second sub-pixel 320 includes a sub-signal in a positive polarity and a sub-signal in a negative polarity. Then each first sub-pixel 310 and each second sub-pixel 320 of the display panel is charged with sub-signals of different polarities in one cycle, so that the characteristics of the liquid crystal molecules therein are prevented from being compromised. Of course, it can be also configured that either one of the first sub-pixel 310 and the second sub-pixel 320 is charged with sub-signals of different polarities in one cycle, the disclosure is not limited thereto.

In an embodiment, further referring to FIGS. 5-7, in one cycle, it can be further configured that the number of sub-signals in positive polarity and the number of sub-signals in negative polarity charging the same first sub-pixel 310 may be configured to be the same; and the number of sub-signals in the positive polarity is the same as the number of sub-signals in the negative polarity charging the same second sub-pixel 320. Then the positive and negative polarities cancel each other, which further effectively prevents the characteristics of the liquid crystal molecules from being compromised.

In an embodiment, in a case the first drive mode is a 1+2 line invert drive mode and the second drive mode is a 2 line invert drive mode, when 4 in frames are taken as one cycle and in is a positive integer greater than or equal to 1, it is convenient to configure the number of frames in which the data signal b being outputted according to the first drive mode and the number of frames in which the data signal b being outputted according to the second drive mode are configured to be the same in one cycle. And the number of sub-signals in the positive polarity is the same as the number of sub-signals in the negative polarity charging the same first sub-pixel 310 and the same second sub-pixel 320.

In one embodiment, referring to FIG. 5, in an embodiment, in is configured to be 1, i.e., four frames are taken for one cycle. The data signal b is outputted according to the first drive mode in the first frame and the second frame in one cycle, and data signal b is outputted according to the second drive mode in the third frame and the fourth frame in one cycle. As shown in figures, for the first frame, in the period the first eight scan lines 100 providing eight scan signals row by row, the polarity of the data signal on the corresponding data line 200 sequentially experiences positive, negative, negative, positive, positive, negative, negative, positive. For the second frame, in the period the first eight scan lines 100 providing eight scan signals row by row, the polarity of the data signal on the corresponding data line 200 sequentially experiences negative, positive, positive, negative, negative, positive, positive, and negative. For the third frame, in the period the first eight scan lines 100 providing eight scan signals row by row, the polarity of the data signal on the corresponding data line 200 sequentially experiences positive, positive, negative, negative, positive, positive, negative, and negative. For the fourth frame, in the period the first eight scan lines 100 providing eight scan signals row by row, the polarity of the data signal on the corresponding data line 200 sequentially experiences negative, negative, positive, positive, negative, negative, positive, and positive.

Referring to FIG. 6, in another embodiment, four frames are taken as one cycle. The data signal b is outputted according to the first drive mode in the first frame and the third frame in one cycle, and the data signal b is outputted according to the second drive mode in the second frame and the fourth frame in one cycle. As shown, for the first frame, in the period the first eight scan lines 100 providing eight scan signals row by row, the polarity of the data signal on the corresponding data line 200 sequentially experiences positive, negative, negative, positive, positive, negative, negative, positive. For the second frame, in the period the first eight scan lines 100 providing eight scan signals row by row, the polarity of the data signal on the corresponding data line 200 sequentially experiences positive, positive, negative, negative, positive, positive, negative, and negative. For the third frame, in the period the first eight scan lines 100 providing eight scan signals row by row, the polarity of the data signal on the corresponding data line 200 sequentially experiences negative, positive, positive, negative, negative, positive, positive, and negative. For the fourth frame, in the period the first eight scan lines 100 providing eight scan signals row by row, the polarity of the data signal on the corresponding data line 200 sequentially experiences negative, negative, positive, positive, negative, negative, positive, and positive.

Referring to FIG. 7, in another embodiment, four frames are taken as one cycle. The data signal b is outputted according to the first drive mode in the first frame and the fourth frame in one cycle, and the data signal b is outputted according to the second drive mode in the second frame and the third frame in one cycle. As shown, for the first frame, in the period the first eight scan lines 100 providing eight scan signals row by row, the polarity of the data signal on the corresponding data line 200 sequentially experiences positive, negative, negative, positive, positive, negative, negative, positive. For the second frame, in the period the first eight scan lines 100 providing eight scan signals row by row, the polarity of the data signal on the corresponding data line 200 sequentially experiences positive, positive, negative, negative, positive, positive, negative, and negative. For the third frame, in the period the first eight scan lines 100 providing eight scan signals row by row, the polarity of the data signal on the corresponding data line 200 sequentially experiences negative, negative, positive, positive, negative, negative, positive, and positive. For the fourth frame, in the period the first eight scan lines 100 providing eight scan signals row by row, the polarity of the data signal on the corresponding data line 200 sequentially experiences negative, positive, positive, negative, negative, positive, positive, and negative.

In the embodiments of the present disclosure, the output mode of the data driver control data signal may not have periodicity, and may take an even number of frames as one frame group. In one frame group, the number of frames in which the data signal b being outputted according to the first drive mode and the number of frames in which the data signal b being outputted according to the second drive mode are the same. Therefore, the superposition display effect of each sub-pixel in each frame group is relatively uniform, so that the overall display effect is relatively uniform.

In the embodiments of the present disclosure, similar to each of the frames in the previous one cycle, in each of the frames in one frame group, it can also be configured that the sub-signals charging the same first sub-pixel 310 include a sub-signal of positive polarity and a sub-signal of negative polarity. The sub-signals charging the same second sub-pixel 320 may also include a sub-signal in a positive polarity and a sub-signal in a negative polarity at the same time. Further, it may be configured in one frame group that the number of sub-signals in the positive polarity is the same as the number of sub-signals in the negative polarity charging the same first sub-pixel 310. Further, in one frame group, the number of sub-signals in the positive polarity is the same as the number of sub-signals in the negative polarity charging the same second sub-pixel 320.

A display panel according to an embodiment of the present disclosure includes scan lines 100, data lines 200, and a data driver. The scan lines 100 extend in a first direction and are configured to provide a scan signal a. One scan line 100 provides a scan signal a for a duration T. The data lines 200 extend in a second direction and are arranged intersecting the scan lines 100, and are configured to provide a square wave data signal b. The data driver is connected with the data line 200 and is configured to control the output mode of the data signal b.

The output mode of the data signal b includes a first drive mode and a second drive mode. The first drive mode is the described 1+2 line invert drive mode, that is, after the scan signal is applied, the polarity of the data signal is firstly inverted after one T and then inverted every 2T. The second drive mode is the described 2 line invert drive mode, that is, after the scan signal is applied, the polarity of the data signal is inverted every 2T.

The data driver controls the data signal and the data signal is outputted according to the first drive mode in the previous frame and according to the second drive mode in the next frame.

In one embodiment, in the first frame, the data driver controls the data line 200 connected thereto so that the data signal b thereon is outputted according to the 1+2 line invert drive mode of. In the second frame, the data driver controls the data line 200 connected thereto so that the data signal b thereon is outputted according to the 2 line invert drive mode. Then, in the third frame, the data signal b is outputted according to the 1+2 line invert drive mode; in the fourth frame, the data signal b is outputted in a 2 line invert drive mode, and sequentially over again. As described above, the display effect on the first sub-pixel 310 and second sub-pixel 320 in the same sub-pixel group 300 and by the 2 line invert drive mode and the 1+2 line invert drive mode are opposite, therefore, the overall visual display effect obtained by integrating the brightness effect of each of the frames are more uniform.

What is claimed is:

1. A display panel comprising:

scan lines extending in a first direction and configured to provide a scan signal;

data lines extending in a second direction and intersecting the scan lines and configured to provide a square wave data signal; wherein a waveform of the data signal comprises a plurality of sub-wave forms, the sub-wave forms having a starting end and a trailing end; at the starting end, a polarity of the data signal is inverted and the data signal gradually rises toward a predetermined value; and at the trail end, the polarity of the data signal is constant and the data signal reaches the predetermined value;

a sub-pixel group connected to the scan lines and the data lines; the sub-pixel group comprising a first sub-pixel and a second sub-pixel; and a data driver connected to the data lines and configured to control an output mode of the data signal, the output mode comprising a first drive mode and a second drive mode; in the first drive mode, the first sub-pixel is charged through the data signal at the starting end, and the second sub-pixel is charged through the data signal at the trailing end; in the second drive mode, the first sub-pixel is charged through the data signal of the trail end, and the second sub-pixel is charged through the data signal of the starting end;

wherein the data driver controls the data signal and the data signal is outputted according to the first drive mode in one frame and according to the second drive mode in another frame.

2. The display panel according to claim 1, wherein the data driver controls an output mode of the data signal and a plurality of frames are taken as one cycle.

3. The display panel according to claim 2, wherein the plurality of frames are 2n frames, wherein n is a positive integer greater than or equal to 1.

4. The display panel according to claim 3, wherein in one cycle, the number of frames in which the data signal being outputted according to the first drive mode is the same as the number of frames in which the data signal being outputted according to the second drive mode.

5. The display panel according to claim 4, wherein the data signal comprises a plurality of sub-signals, when the scan lines provide one scan signal, the data lines provide one sub-signal; wherein in each of the frames of one cycle, the sub-signals charging the same first sub-pixel comprise a sub-signal in a positive polarity and a sub-signal in a negative polarity.

6. The display panel according to claim 5, wherein in each of the frames of one cycle, the sub-signals charging the same second sub-pixel comprise a sub-signal in the positive polarity and a sub-signal in the negative polarity.

7. The display panel according to claim 6, wherein in one cycle, the number of sub-signals in the positive polarity is the same as the number of sub-signals in the negative polarity charging the same first sub-pixel.

8. The display panel according to claim 7, wherein in one cycle, the number of sub-signals in the positive polarity is the same as the number of sub-signals in the negative polarity charging the same second sub-pixel.

9. The display panel according to claim 4, wherein the data signal is outputted in a first half cycle according to the first drive mode, and the data signal is outputted in a second half cycle according to the second drive mode in one cycle.

10. The display panel according to claim 3, wherein $1 \leq n \leq 4$.

11. The display panel according to claim 1, wherein a duration of one scan line providing one scan signal is T;

in the first drive mode, after the scan signal is applied, the polarity of the data signal is firstly inverted in one T and then inverted every 2T.

12. The display panel according to claim 11, wherein in the second drive mode, after the scan signal is applied, the polarity of the data signal is inverted every 2T.

13. The display panel according to claim 12, wherein the data driver controls an output mode of the data signal and 4m frames are taken as one cycle, where in is a positive integer greater than or equal to 1.

14. The display panel according to claim 13, wherein m=1, the data signal is outputted according to the first drive mode in a first frame and a second frame in one cycle, and the data signal is outputted according to the second drive mode in a third frame and a fourth frame in one cycle.

15. The display panel according to claim 13, wherein m=1, the data signal is outputted according to the first drive mode in a first frame and a third frame in one cycle, and the data signal is outputted according to the second drive mode in a second frame and a fourth frame in one cycle.

16. The display panel according to claim 13, wherein m=1, the data signal is outputted according to the first drive mode in a first frame and a fourth frame in one cycle, and the data signal is outputted according to the second drive mode in a second frame and a third frame in one cycle.

17. The display panel according to claim 1, wherein the data driver controls an output mode of the data signal and 2n frames are taken as a frame group, wherein n is a positive integer greater than or equal to 1; and in the one frame group, the number of frames in which the data signal being outputted according to the first drive mode is the same as the number of frames in which the data signal being outputted by the second drive mode.

18. The display panel according to claim 17, wherein the data signal comprises a plurality of sub-signals, when the scan lines provide one scan signal, the data lines provide one sub-signal;

in each of the frames of the one frame group, the sub-signals charging the same first sub-pixel comprise a sub-signal in a positive polarity and a sub-signal in a negative polarity; and in each of the frames of the one frame group, the sub-signals charging the same second sub-pixel comprise a sub-signal in the positive polarity and a sub-signal in the negative polarity.

19. The display panel according to claim 18, wherein in the one frame group, the number of sub-signals in the positive polarity is the same as the number of sub-signals in the negative polarity charging the same first sub-pixel; and in the one frame group, the number of sub-signals in the positive polarity is the same as the number of sub-signals in the negative polarity charging the same second sub-pixel.

* * * * *